US008506237B2

(12) United States Patent
Japikse et al.

(10) Patent No.: US 8,506,237 B2
(45) **Date of Patent: *Aug. 13, 2013**

(54) RADIAL-FLOW TURBOMACHINES HAVING PERFORMANCE-ENHANCING FEATURES

(75) Inventors: David Japikse, Woolwich, ME (US); Kevin D. Fairman, Lunenburg, MA (US); Tsuguji Nakano, West Chester, OH (US); Douglas M. DeBenedictis, Westford, MA (US); Frederick L. Zink, White River Junction, VT (US); Daniel V. Hinch, Norwich, VT (US)

(73) Assignee: Concepts ETI, Inc., White River Junction, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/344,816

(22) Filed: Jan. 6, 2012

(65) Prior Publication Data

US 2013/0022449 A1 Jan. 24, 2013

Related U.S. Application Data

(63) Continuation-in-part of application No. 12/047,215, filed on Mar. 12, 2008, now Pat. No. 8,100,631.

(51) Int. Cl.
*F01D 17/00* (2006.01)

(52) U.S. Cl.
USPC ..... 415/93; 415/102; 415/149.1; 415/151; 415/152.2; 415/157; 415/159

(58) Field of Classification Search
USPC ..... 415/93, 94, 98, 101, 102, 148, 149.1, 415/151, 152.2, 154.1, 157, 158, 159, 165
See application file for complete search history.

(56) References Cited

U.S. PATENT DOCUMENTS

| | | | | |
|---|---|---|---|---|
| 2,425,171 | A | | 8/1947 | Bennett,et al. |
| 2,672,954 | A | | 3/1954 | Bennett |
| 2,689,476 | A | | 9/1954 | Van Ornum |
| 3,889,775 | A | * | 6/1975 | Luscher ..... 415/158 |
| 4,744,724 | A | | 5/1988 | Brassert et al. |
| 5,345,827 | A | | 9/1994 | Brassert et al. |
| 5,426,986 | A | | 6/1995 | Brassert et al. |
| 5,509,315 | A | | 4/1996 | Brassert et al. |
| 8,100,631 | B2 | | 1/2012 | DeBenedictis et al. |

OTHER PUBLICATIONS

Eric E. Ungar, Structural Damping, Noise and Vibration Control Engineering: Principles and Applications, Chapter 12, ISBN 0-471-61751-2; 1992 John Wiley & Sons, Inc., pp. 451-453.

(Continued)

*Primary Examiner* — Igor Kershteyn
(74) *Attorney, Agent, or Firm* — Downs Rachlin Martin PLLC

(57) ABSTRACT

A turbomachine that includes a radial-flow impeller and one or more of a variety of features that enhance the performance of machinery in which the turbomachine is used. For example, when the turbomachine is used in a dynamometer, the features enhance the useful shaft horsepower range of the dynamometer. One of the features is a variable-restriction intake that allows for adjusting flow rate to the impeller. Other features include a unique impeller shroud and a shroud guide each movable relative to the impeller. Yet another feature is an exhaust diffuser that facilitates an increase in the range of shaft power and the reduction of deleterious vibration and noise. The turbomachine can also include a unique impeller blade configuration that cooperates with the adjustable intake and the exhaust diffuser to enhance flow through the turbomachine.

33 Claims, 10 Drawing Sheets

(56) References Cited

OTHER PUBLICATIONS

M.S. Howe and H.D. Baumann, Noise of Gas Flows, Noise and Vibration Control Engineering: Principles and Applications, Chapter 14, ISBN 0-471-61751-2; 1992 John Wiley & Sons, Inc., pp. 519-533.

First Office Action dated May 9, 2011 in connection with related U.S. Appl. No. 12/047,215, filed Mar. 12, 2008 entitled entitled "Fluid-Type Absorption Dynamometer Having an Enhanced Power Range," Douglas M. Debenedictis et al.

Response to First Office Action dated Aug. 8, 2011 in connection with related U.S. Appl. No. 12/047,215, filed Mar. 12, 2008 entitled "Fluid-Type Absorption Dynamometer Having an Enhanced Power Range," Douglas M. Debenedictis et al.

* cited by examiner

RADIAL-FLOW TURBOMACHINES HAVING PERFORMANCE-ENHANCING FEATURES

RELATED APPLICATION DATA

This application is a continuation-in-part application of U.S. patent application Ser. No. 12/047,215, filed on Mar. 12, 2008 (now U.S. Pat. No. 8,100,631), which is incorporated by reference herein in its entirety.

FIELD OF THE INVENTION

The present invention generally relates to the field of turbomachinery. In particular, the present invention is directed to radial-flow turbomachines having performance-enhancing features.

BACKGROUND

Fluid-type absorption dynamometers have proven useful in various applications. For example, air absorption dynamometers of suitable construction have been useful in the field-testing of aircraft engines, and, particularly, helicopter engines. As will be appreciated, a dynamometer capable of using air as the working fluid is especially desirable for field-testing in that the supply, storage, and use issues (e.g., freezing) of alternative fluids are eliminated. A fluid is anything that flows.

Some fluid-type absorption dynamometers, such as disclosed in U.S. Pat. No. 4,744,724 to Brassert et al., have provided a movable shroud to selectively occlude the blades of a driven impeller that absorbs power from the load under test. With such a movable shroud, the power absorbed by the device may be changed at any operating rotational speed. Despite this advantage, impediments to a wider adoption of fluid-type absorption dynamometer technology have remained. One such impediment has been a restricted power range for which a given dynamometer is usable. A wider range, of course, would be desirable since it would permit a single dynamometer to be used in testing a wider range of engine designs having a wider range of shaft-horsepower outputs.

SUMMARY OF THE DISCLOSURE

In one implementation, the present disclosure is directed to a machine including a radial-flow turbomachine that includes: a housing; an impeller rotatably mounted in the housing for receiving rotational energy from an external rotating driver when the radial-flow turbo machine is operating, the impeller having a fluid intake region and an annular fluid exhaust region located radially outward from the fluid intake region; and a fluid intake for communicating a fluid to the fluid intake region of the impeller as an intake fluid flow when the radial-flow turbomachine is operating, the fluid intake including an adjustable throttling device that allows the intake fluid flow to be selectably restricted.

In another implementation, the present disclosure is directed to a machine including a radial-flow turbomachine that includes: a housing; an impeller rotatably mounted in the housing for receiving rotational energy from an external rotating driver when the radial-flow turbo-machine is operating, the impeller having a rotational axis, a fluid intake region, and a fluid exhaust region located radially outward from the fluid intake region, the impeller including: a blade support extending radially from the rotational axis; and a plurality of blades distal from the rotational axis, each of the plurality of blades secured to the blade support having a longitudinal axis extending parallel to the rotational axis; an exhaust diffuser in fluid communication with the fluid exhaust region of the impeller; and a movable cylindrical impeller-blade shroud concentric with the rotational axis, the movable cylindrical impeller-blade shroud being locatable only radially outward of the plurality of blades relative to the rotational axis of the impeller and movable so as to variably occlude the exhaust diffuser.

In still another implementation, the present disclosure is directed to a machine including a radial-flow turbomachine that includes: a housing; an impeller rotatably mounted in the housing for receiving rotational energy from an external rotating driver when the radial-flow turbomachine is operating, the impeller having a rotational axis, a fluid intake region, and a fluid exhaust region located radially outward from the fluid intake region, the impeller including: a blade support extending radially from the rotational axis; and a plurality of blades distal from the rotational axis, each of the plurality of blades secured to the blade support having a longitudinal axis extending parallel to the rotational axis, wherein each of the plurality of blades has a leading edge, a trailing edge and a free end extending between the leading and trailing edges, the trailing edge being disposed radially farther from the rotational axis of the impeller than the leading edge, the leading and trailing edges being angled to converge toward one another to a point beyond the free end; and an impeller shroud.

In yet another implementation, the present disclosure is directed to a machine including a radial-flow turbomachine that includes: a housing; an impeller rotatably mounted in the housing for receiving rotational energy from an external rotating load when the radial-flow turbomachine is operating, the impeller having a rotational axis, an outer circumferential periphery, a fluid intake region, and an annular fluid exhaust region located radially outward from the fluid intake region; a first exhaust diffuser in fluid communication with the fluid exhaust region; a center diffuser substantially aligned with the circumferential periphery of the impeller in a direction parallel to the rotational axis of the impeller, the center diffuser located radially outward relative to the impeller; and a first outer diffuser offset from the center outlet baffle in a direction parallel to the rotational axis of the impeller so as to define a first portion of the first exhaust diffuser between the first outer diffuser and the center diffuser.

In still yet another implementation, the present disclosure is directed to a machine including a radial-flow turbomachine that includes: a housing; an impeller rotatably mounted in the housing for receiving rotational energy from an external rotating load when the radial-flow turbomachine is operating, the impeller having a rotational axis, a fluid intake region, and a fluid exhaust region located radially outward from the fluid intake region, the impeller including: a blade support extending radially from the rotational axis; and a plurality of blades distal from the rotational axis, each of the plurality of blades secured to the blade support having a longitudinal axis extending parallel to the rotational axis; and an exhaust diffuser in fluid communication with the fluid exhaust region of the impeller and having an inlet proximate to the fluid exhaust region and an outlet distal from the inlet, the exhaust diffuser having a shape selected so that, when the inlet is receiving supersonic airflow, the shape causes the supersonic flow to experience a shock within the exhaust diffuser and causes flow at the exit to be subsonic.

BRIEF DESCRIPTION OF THE DRAWINGS

For the purpose of illustrating the invention, the drawings show aspects of one or more embodiments of the invention.

However, it should be understood that the present invention is not limited to the precise arrangements and instrumentalities shown in the drawings, wherein.

DETAILED DESCRIPTION

Figure 1:
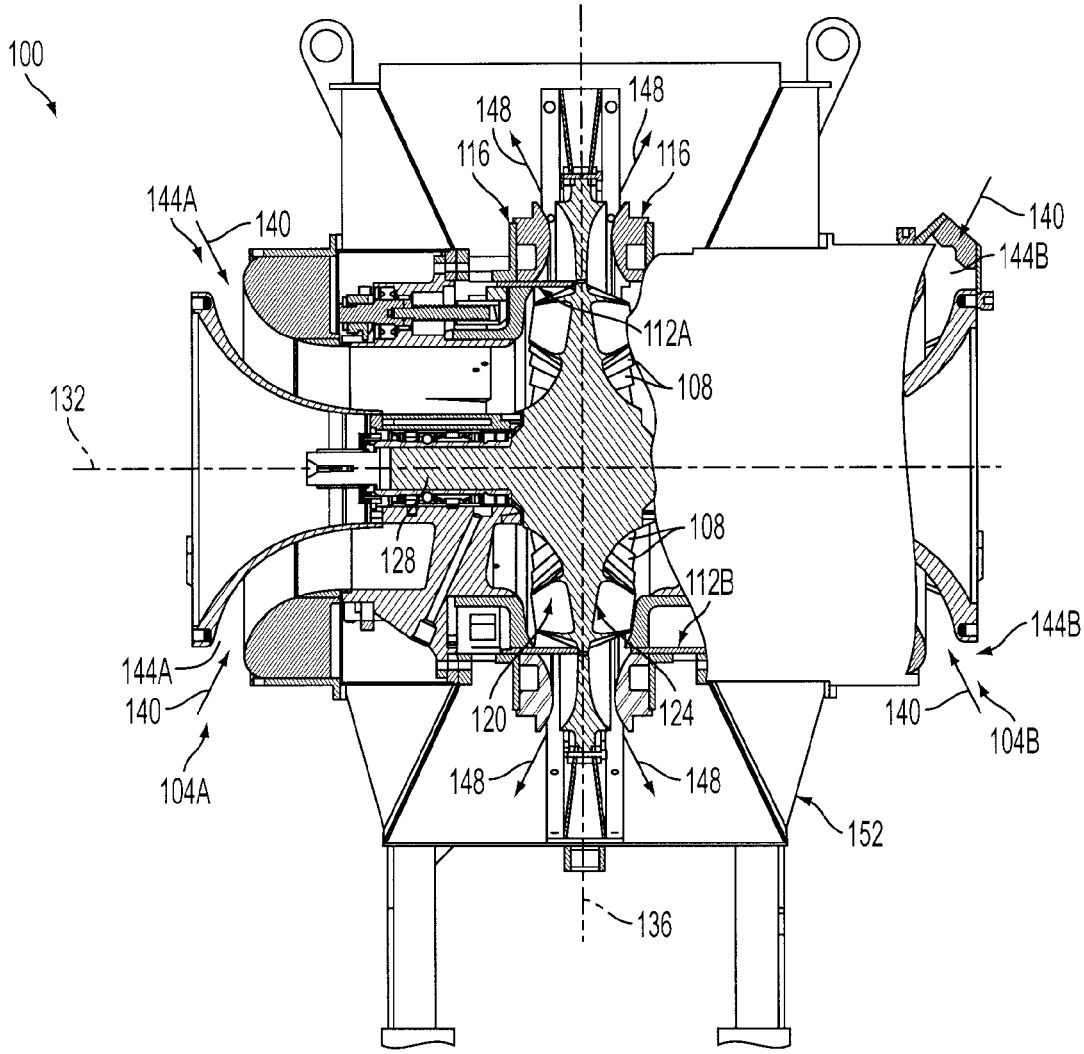
FIG. 1 is a partial vertical cross-sectional/partial elevational view of one embodiment of a turbomachine made incorporating features of the present invention, the cross-sectional portion taken through the rotational axis of the impeller.

Referring now to the drawings, FIG. 1 illustrates an exemplary turbomachine 100 that includes a number of special features that enhance the performance of the turbomachine. For example, when turbomachine 100 is used in a fluid-type dynamometer, a performance enhancement resulting from the special features is an increase in the dynamometer's power range. While a fluid-type dynamometer is used as a primary example of a use for a turbomachine made in accordance with the present disclosure, such as turbomachine 100 of FIG. 1, those skilled in the art will understand that these special features can be implemented singly and in various combinations with one another in applications other than dynamometers, such as fans and blowers. As an example, turbomachine 100 can be used in a blower, with the primary difference being that in a blower the machine (not shown) that drives the turbomachine is permanently attached, whereas the machines (not shown) in the dynamometer arrangement are only temporarily attached for dynametric testing. The special features, which are each described below in the context of exemplary turbomachine 100 for convenience, include variable-restriction intakes 104A, 104B, uniquely shaped impeller blades 108, a pair of movable impeller shrouds 112A, 112B, and a set 116 of exhaust diffusers, among others. However, those skilled in the art will readily understand how to implement these features in other turbomachines.

At a high level, turbomachine 100 comprises a rotor 120 that includes an impeller 124 affixed to a shaft 128 and rotates about a rotational axis 132 when the turbomachine is in use, i.e., is driven by an external rotational machine (not shown), for example, an engine, turbine, electric motor, or any other type of machinery that provides rotational output energy. In this connection, one or both ends of shaft 128 may be suitably configured, for example, in any conventional manner, for connecting the external machine to turbomachine 100. Exemplary turbomachine 100 is generally symmetrical about a plane 136 that bisects impeller 124 and is perpendicular to rotational axis 132 and includes one of intakes 104 at each end. This arrangement is often referred to as a "double entry" impeller arrangement. As described in more detail below, the action of the impeller 124 converts a generally axial inflow 140 of air (or other fluid) at inlets 144A, 144B of intakes 104A, 104B, respectively, into a generally radial exhaust flow 148 of fluid, for example, air, from the turbomachine 100. Turbomachine 100 may be supported in any suitable manner, such as by a support frame 152 that supports it from below. Before proceeding with a description of exemplary turbomachine 100, for the sake of clarity the inventors first address dynamometer classification and terminology.

Dynamometers embody a complex and diverse set of machines. Classical dynamometers ("dynos") include eddy-current, water-brake, and turbomachinery types. Eddy-current dynos use electro-motive forces to absorb power, water-brake types use parallel rotating disks to dissipate power by the frictional heating of water, and turbomachinery dynos follow the Euler Turbomachinery Equation, which states that the power done on or extracted from a fluid is equal to the mass flow rate times the exit peripheral (metal) velocity of the impeller times the tangential component of the impeller exit fluid velocity, as taken in the stationary reference frame. The latter can be called "turbo dynos" for simplicity.

Turbo dynos fall into two principal categories: 1) those which use an impeller intended principally for axial inlet and exit flow, and 2) those which use an impeller intended principally for radial exit flow. Additionally, means for measuring torque are sometimes added into the process. An early example of the axial style turbo dyno is given by U.S. Pat. No. 2,689,476 to Ornum in which the flow is introduced axially into a common axial-style impulse type impeller with no involvement with radial flow to achieve power dissipation. In fact, Ornum specifically states that his dynamometer wheel works with fluid injected "into the path of the blades 28 without acquiring any radial component of velocity." The Ornum patent, col. 2, lines 26-28. Hence Ornum specifically states that he is considering only pure-axial-flow turbomachinery and excludes radial flow. Actually, his statement is technically slightly wrong, because the machine then permits the flow to spill or drain out into a somewhat unconstrained plenum or collector region, and this will require some radial velocity component, however slight it may be (but this component cannot play any direct role in power absorption). Ornum then uses his collector region as a second device, namely, a torque meter by including simple flat plate swirl brakes to eliminate any of the original angular momentum from the axial flow impeller and to use the force or torque impressed on these swirl brakes to indicate the actual torque being imposed upon the dyno.

Unfortunately, Ornum calls his flat plate swirl brakes "stator blades." Common terminology today does not use "stator blades" for the function described, since these plates are not involved in any way, shape, or form with the actual work absorbed by the impeller, and hence the load capacity, of the dyno. In short, remove the so-called "stator blades" and the impeller itself will still absorb the same power (but the torque measurement would be gone). Commonly today, those skilled in the art would use the term "stator blade" only for aerodynamically-shaped surfaces that participate in the actual work transfer process.

An example of a radial-flow turbo dyno is shown in U.S. Pat. No. 4,744,724 to Brassert et al. The Brassert et al. patent describes a style of dyno that uses radial flow through an impeller, wherein the flow is initially axial at inlet, then is turned nearly 90 degrees, then enters into the impeller in an essentially radial direction, then exits the impeller still in a nominal radial direction but with a large tangential component as required by the Euler Equation for maximum power extraction. Brassert et al. allow flow to spill out of their impeller into a collector with substantial radial momentum but does not use a swirl brake since they do not need to measure torque internal to their dyno.

Historically, the Ornum and the Brassert patents correctly portray two distinct turbomachinery classes and the patents correctly memorialize this fact; but a full understanding of the functionality requires correctly identifying which elements actually participate in the work transfer process. In the present disclosure, diffuser passages are added downstream of the impeller and these do play an active role in the performance of the impeller and hence power absorption; namely, the diffuser reduces the impeller exit static pressure hence drawing more flow through said impeller and increasing the power absorbed, as subsequent data clearly shows.

Terminology for the complex diffusers employed herein in describing and claiming turbomachines made in accordance with the present invention refer to the actual diffuser passage as an "exit diffuser" and the surfaces of the diffuser as "diffuser elements" and "diffusers." Likewise, at the inlet, in one aspect the present disclosure teaches the use of an annular throttling device that is an intrinsic part of the axisymmetric flow path and, depending on flow conditions, permits both subsonic and supersonic flow through the device with very little throttling loss due to the natural downstream recovery of the annular diffusing passage. In contrast, the Ornum machine uses external valves that are limited to subsonic flow with very high throttling losses (no downstream recovery). These differences are clear to those practiced in the art of diffuser and valve design.

Figure 2:
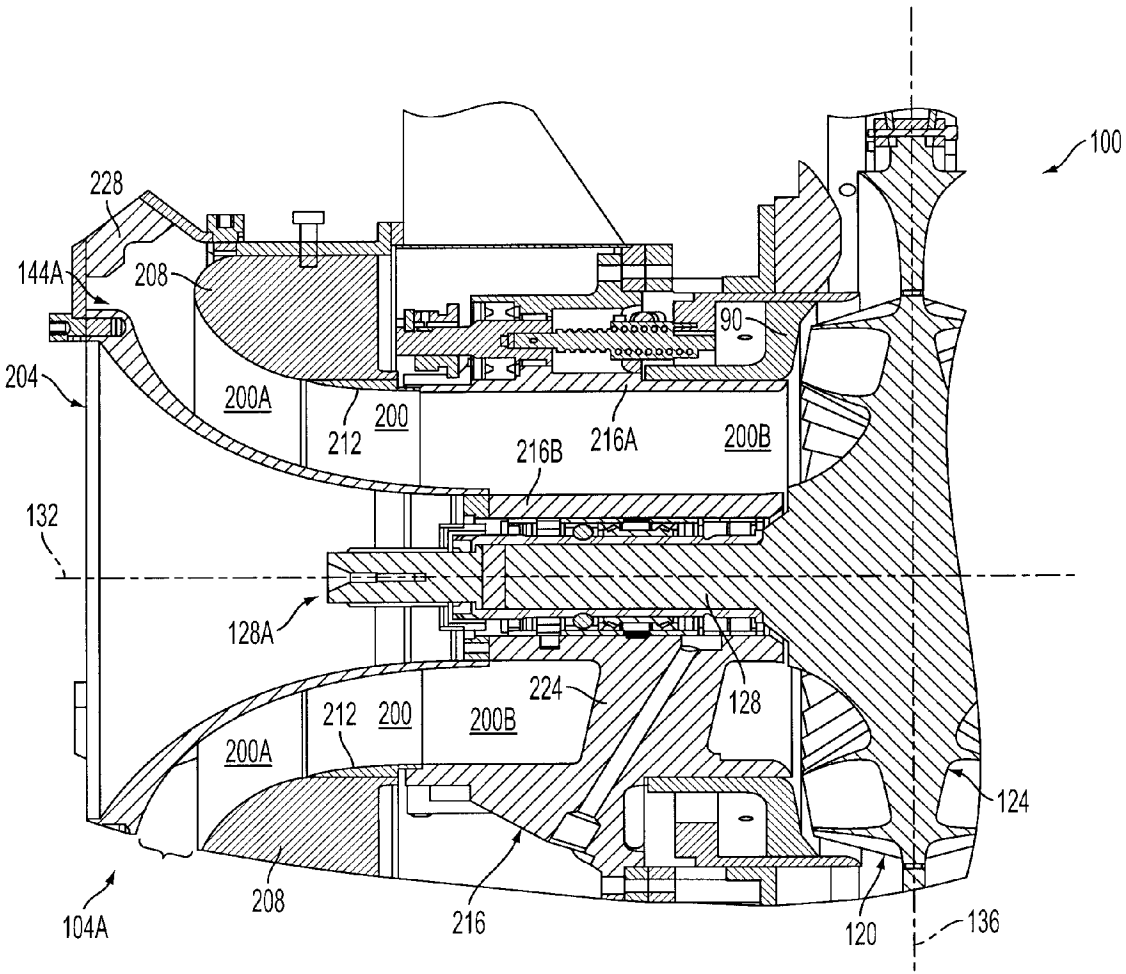
FIG. 2 is an enlarged cross-sectional partial view showing one side of the turbomachine of FIG. 1 illustrating structure that defines various parts of one of the turbomachine's intakes.

Returning now to details of exemplary turbomachine 100, FIG. 2 illustrates the left half of turbomachine 100 of FIG. 1 in more detail than FIG. 1. Though FIG. 2 generally shows only one-half of turbomachine 100 for simplicity, it will be appreciated that the not-shown right half of the dynamometer may be the mirror image of the left half about plane 136, such that a fluid, for example, air, flows into the turbomachine from both of its axial ends as mentioned above. As seen in FIG. 2, left intake 104A includes an intake duct 200 defined by various surfaces of a number of structures of turbomachine 100, as described below. Intake duct 200 is generally annular in cross-section perpendicular to rotational axis 132 along most of its length. In the embodiment shown, intake duct 200 is largely axial relative to rotational axis 132 but has an outwardly curved portion 200A that fluidly connects left inlet 144A to a truly axial portion 200B. While intake duct 200 is shown with this configuration, those skilled in the art will understand that a variety of other intake duct configurations are possible, such as entirely outwardly curved starting proximate impeller 124 or more axial than shown.

Outwardly curved portion 200A of intake duct 200 is defined for the most part by corresponding respective surfaces of a bell-shaped structure 204, an annular structure 208 and a filler ring 212. As will be appreciated by those skilled in the art, these surfaces should be suitably contoured to promote well-ordered flow within intake duct 200. Axial portion 200B of intake duct 200 is largely defined by cylindrical inner and outer portions 216A, 216B of a rotor support 216. In this connection, shaft 128 of rotor 120 may be rotatably mounted in rotor support 216 in any suitable manner, as known in the art. Rotor support 216 may further include a plurality of radial supports 224 that fixedly connect inner and outer portions 216A, 216B together. In this example, rotor support 216 includes three radial supports 224 (only one shown) equally spaced circumferentially around rotational axis 132, and each of the radial supports has an airfoil shape to promote smooth flow within intake duct 200.

Shaft 128 includes an end 128A configured to be coupled to a rotating machine (not shown) (or a suitable intermediate coupling) that drives turbomachine 100. For example, end 128A of shaft 128 may be externally splined to mate with a suitably counter-splined female coupling. Shaft 128 may extend at least partway into bell-shaped structure 204 to be accessible for coupling to an external machine. In this example, shaft 128 does not extend beyond bell-shaped structure 204 to provide a measure of safety against injury from the rotation of the shaft, e.g., when turbomachine 100 is being driven from its right side (see FIG. 1). As particularly shown in FIG. 2, inlet 144A of intake 104A may include a plurality of suitably oriented control vanes 228 (only one shown) disposed around the inlet so as to enhance the smoothness of flow into and through intake duct 200. Those skilled in the art will understand how to configure such control vanes 228 to enhance performance.

One of the unique features of turbomachine 100 particularly mentioned above is that each intake 104A, 104B is a variable-restriction intake. In the example turbomachine 100 of FIG. 2 (and others of the present figures), this variable restriction feature is provided relative to intake duct 200 (as well as the mirror image intake duct on the right side of the turbomachine). That is, intake 104A allows a user to vary the cross-sectional flow area of intake duct 200 so as to allow the user to adjust the operating characteristics of turbomachine 100. For example, when turbomachine 100 is used in a dynamometer, to the load being tested. This variable-restriction feature is illustrated more particularly in FIGS. 3 and 4.

Figure 3:
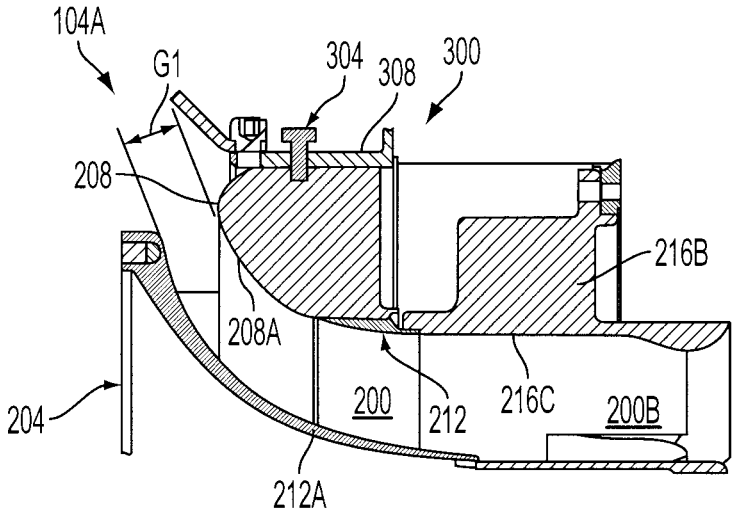
FIG. 3 is an enlarged cross-sectional partial view of the turbomachine of FIG. 1, with some structure deleted for clarity, illustrating the intake duct fully open.
Figure 4:
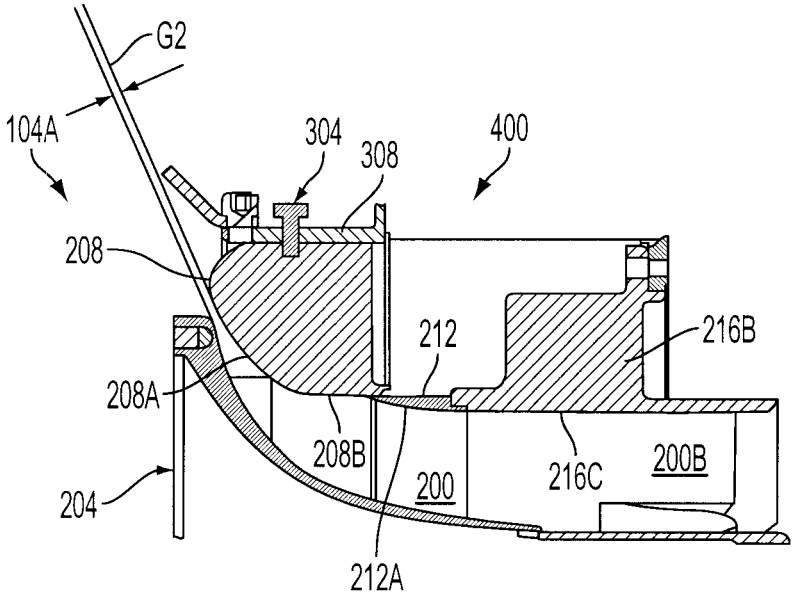
FIG. 4 is an enlarged cross-sectional partial view of the turbomachine of FIG. 1, with some structure deleted for clarity, showing the intake duct nearly fully restricted.

As seen in FIGS. 3 and 4, the flow-restriction feature of exemplary intake 104A is provided by making annular structure 208 movable axially relative to the rest of turbomachine 100, i.e., movable in a direction parallel with rotational axis 132 (FIGS. 1 and 2) so that it can be selectably located closer to or farther from bell-shaped structure 204 so as to provide an intake throttling device for the turbomachine. For example, FIG. 3 illustrates annular structure 208 located in a fully retracted position 300 in which intake duct 200 is least restricted, in this case, unrestricted, by the annular structure. In one example, the gap G1 provided when annular structure 208 is in its fully retracted position is on the order of about 4.5 centimeters (1.78 inches). In contrast, FIG. 4 illustrates annular structure 208 in a fully extended position 400 in which intake duct 200 is most restricted. In one example, the gap G2 provided when annular structure 208 is in its fully extended position is on the order of about 0.0762 centimeter (0.030 inch). Of course, in other embodiments, gaps G1, G2 may be any suitable values that depend on, for example, the desired operating characteristics and ranges of those embodiments.

FIGS. 3 and 4 illustrate how filler ring 212 works in conjunction with annular structure 208 to provide continuity to the outer wall of intake duct 200. In FIG. 3, which shows annular structure 208 in its fully retracted position, the flow-defining surface 212A of filler ring 212 provides a relatively very smooth transition between the flow-defining surfaces 208A, 216C of the annular structure and outer portion 216B of axial portion 200B of intake duct 200. Those skilled in the art will readily appreciate that, in the context of turbomachine 100 being used in a dynamometer application, this retracted position of annular structure 208 is most suitable for testing relatively high-shaft-power loads requiring larger mass-flows of air (or other operating fluid), which are also most demanding in terms of need to avoid discontinuities in the smooth transitioning of the flow-defining surfaces, such as surfaces 208A, 212A, 216C of intake duct 200.

In FIG. 4, on the other hand, annular structure 208 is in a fully extended position that causes somewhat of a discontinuity in the smooth transition between the flow-defining surfaces 208A, 216C of the annular structure and outer portion 216B by virtue of the now-exposed radially inner surface 208B of the annular structure. This discontinuity, however, is not as critical as it would be if it were present in the fully retracted state of annular structure as shown in FIG. 3. This is so because the full extension of annular structure 208 is typically used in a dynamometer context for testing of relatively low-shaft-power loads that require lower mass-flows through turbomachine 100, and the lower mass-flows are more tolerant of fluid recirculation and other flow imperfections.

Still referring to FIGS. 3 and 4, annular structure 208 may be actuated and held in a selected position in any of a variety of ways. In the example shown, annular structure 208 is manually actuated and is held in place by a suitable number of threaded fasteners 304 that each extend through a fixed support 308 and into the annular structure. As those skilled in the art will readily appreciate, at each fastener location, either fixed support 308 or annular structure 208, or both, may be provided with a plurality of suitable openings (not shown), respectively, disposed axially along the corresponding respective component so as to provide the annular structure with a plurality of axial positions where it can be fixed in place so as to create a plurality of corresponding respective discrete gaps (of which gaps G1, G2 are examples). In other embodiments, annular structure 208 may be repositionable in other ways. For example, the radially inner or outer surface of an alternative annular structure (not shown) may be threaded to mate with corresponding respective threads on a fixed support so that when the annular structure is rotated about rotational axis 132, it moves axially in accordance with the pitch of the threads. One or more locking pins (not shown) may be used to prevent the annular structure from rotating during operation of turbomachine 100.

In either of the axially slidable or axially rotatable forms just described, the annular structure (208 in the axially slidable example) may be actuated either manually or automatically. Automatic actuation may be provided by, for example, any one or more of screw-type actuators, gear-type actuators and linear actuators, among others. It is noted that while the intake restrictor in the embodiment shown is a movable annular structure, in other embodiments the restrictor may comprise one or more other components of turbomachine 100. For example, in some other embodiments that have throttling devices comprising an annular structure and a bell-shaped structure similar, respectively, to annular structure 208 and bell-shaped structure 204, the annular structure may be fixed, while the bell-shaped structure is movable so as to function as a throttling device. In yet other embodiments that include an annular structure and a bell-shaped structure similar, respectively, to annular structure 208 and bell-shaped structure 204, both of the structures may be movable toward and away from each other. Such an embodiment may be desirable in some applications due to the fact that any local discontinuities in the otherwise smoothly transitioning flow-engaging surfaces of the intake duct caused by the movable restrictor can be split between two surfaces on opposing sides of the duct.

Figure 5:
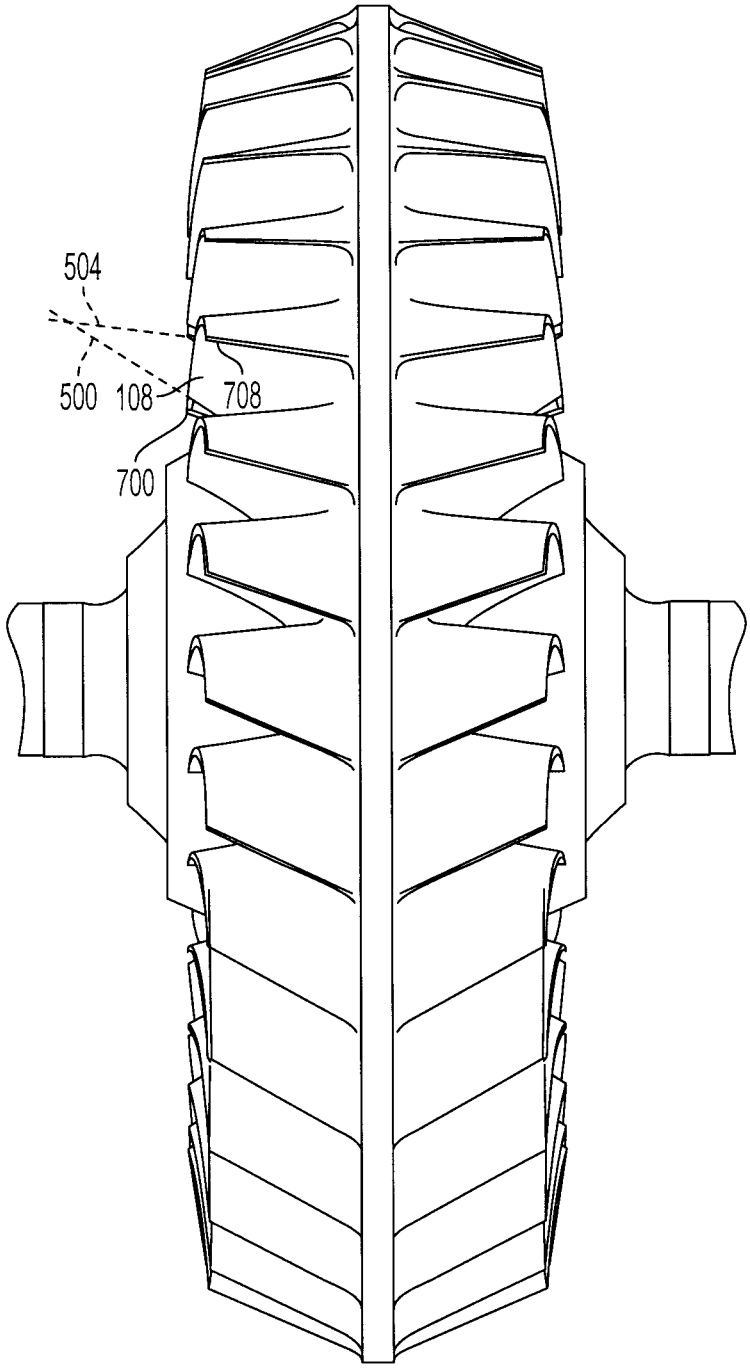
FIG. 5 is an elevational view of the impeller of the turbomachine of FIG. 1 as viewed from a direction perpendicular to the rotational axis of the impeller.
Figure 6:
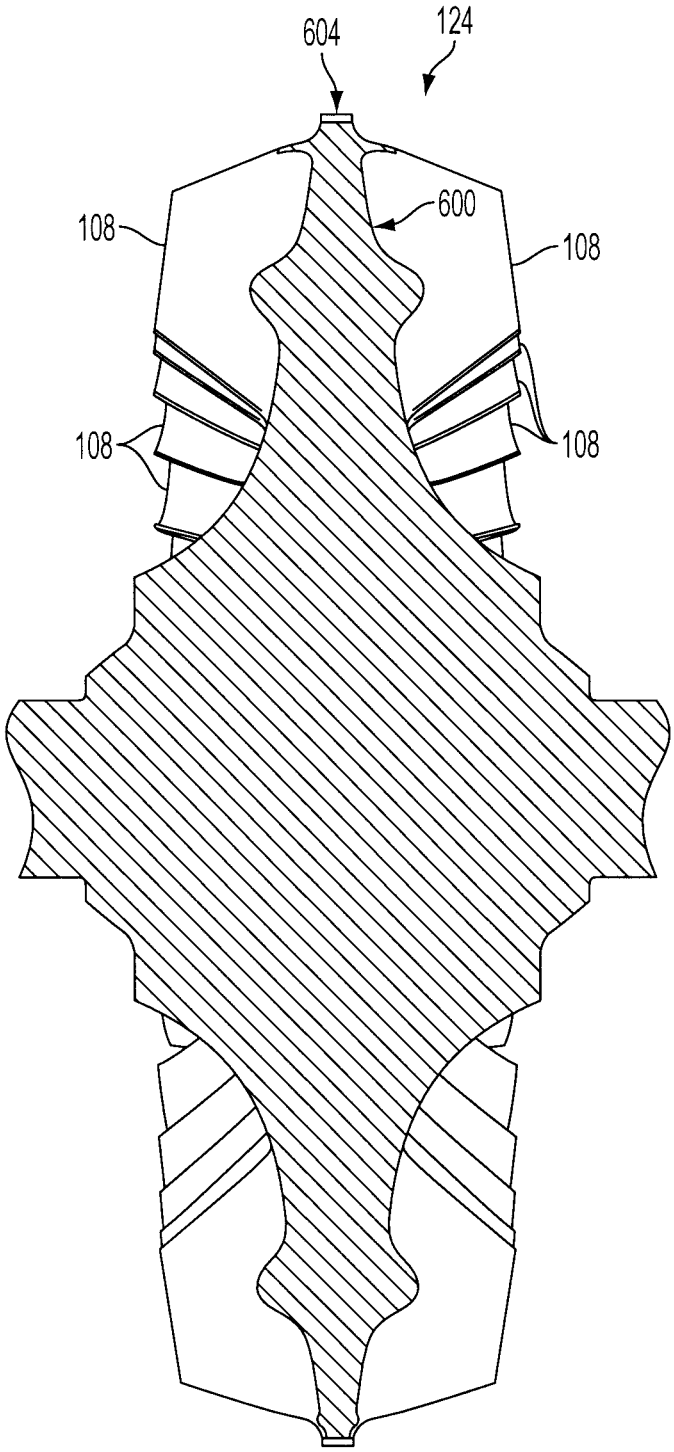
FIG. 6 is a cross-sectional view of the impeller of FIG. 5 taken through the rotational axis of the impeller.
Figure 7:
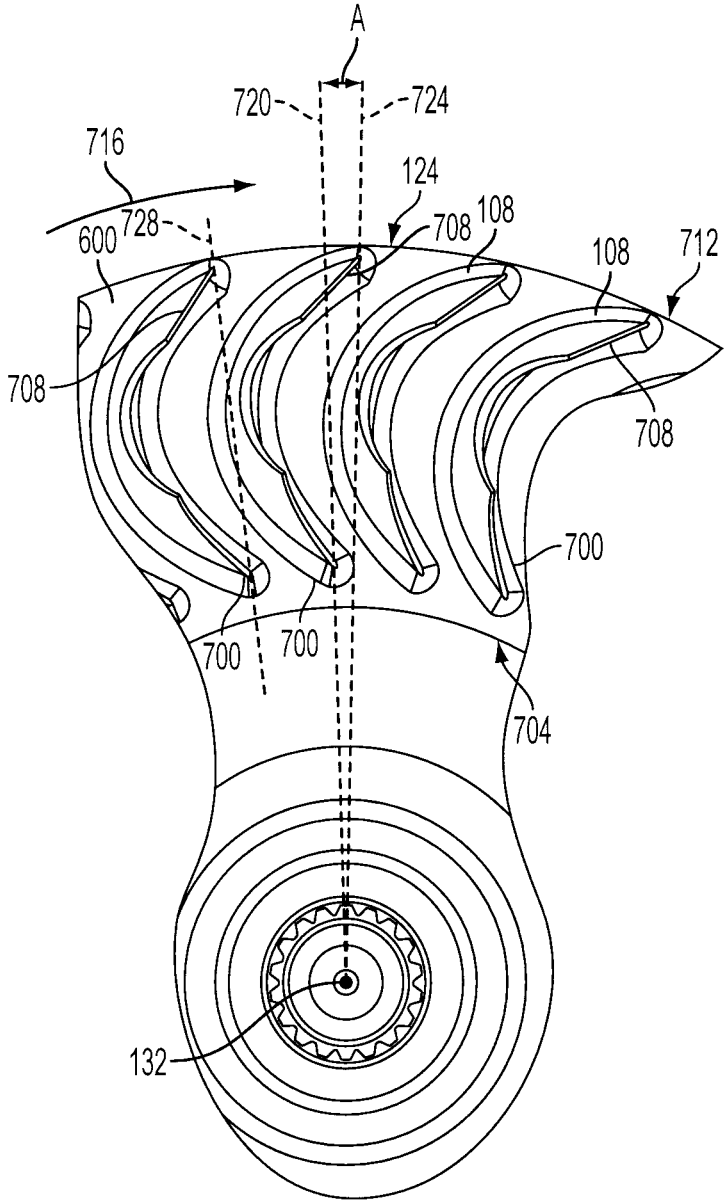
FIG. 7 is an elevational partial view of the impeller of FIG. 5 as viewed from a direction parallel to the rotational axis of the impeller.

Another of the unique features of turbomachine 100 explicitly mentioned above is uniquely shaped impeller blades 108 (FIG. 1). Referring to FIGS. 5-7, FIG. 6 particularly shows that exemplary impeller 124 includes a blade support 600 that supports two sets (one on each side of the blade support) of axially projecting blades 108 located proximate the outer circumference 604 of the impeller and disposed at a constant angular pitch in a circumferential direction around the blade support. Blades 108 may, but need not necessarily, be identical to one another.

Referring to FIG. 7, each blade 108 has a leading edge 700 located at a fluid intake region 704 of impeller 124 and a trailing edge 708 located at a fluid exhaust region 712 of the impeller. In the embodiment shown, in which impeller 124 is designed to rotate in direction 716 (clockwise relative to FIG. 7), each trailing edge 708 is circumferentially advanced, in direction 716, of the leading edge 700 of the corresponding impeller blade 108 by a positive angle A formed between a first radial (relative to rotational axis 132) reference line 720 drawn through the tip of the leading edge and a second radial reference line 724 drawn through the tip of the trailing edge of the same blade. Also in the particular embodiment shown, blades 108 are sized, shaped and positioned such that a straight reference line 728 drawn so as to connect the tips of leading edge 700 and trailing edge 708 at the face of blade support 600 intersects the body of the leading adjacent blade. As seen in each of FIGS. 5-7 by the presence of lines 500, 504 (FIG. 5) drawn along, respectively, leading edge 700 and trailing edge 708 of one of blades 108, the leading and trailing edges of each blade converge toward one another in a direction extending away from blade support 600. With this configuration, when any one of blades 108 is viewed head-on as seen in FIG. 6, the outline of that blade yields a generally trapezoidal blade-profile shape. Of course, in other embodiments, unique blades 108 may be replaced with conventionally shaped blades as desired to suit a particular design.

Figure 8:
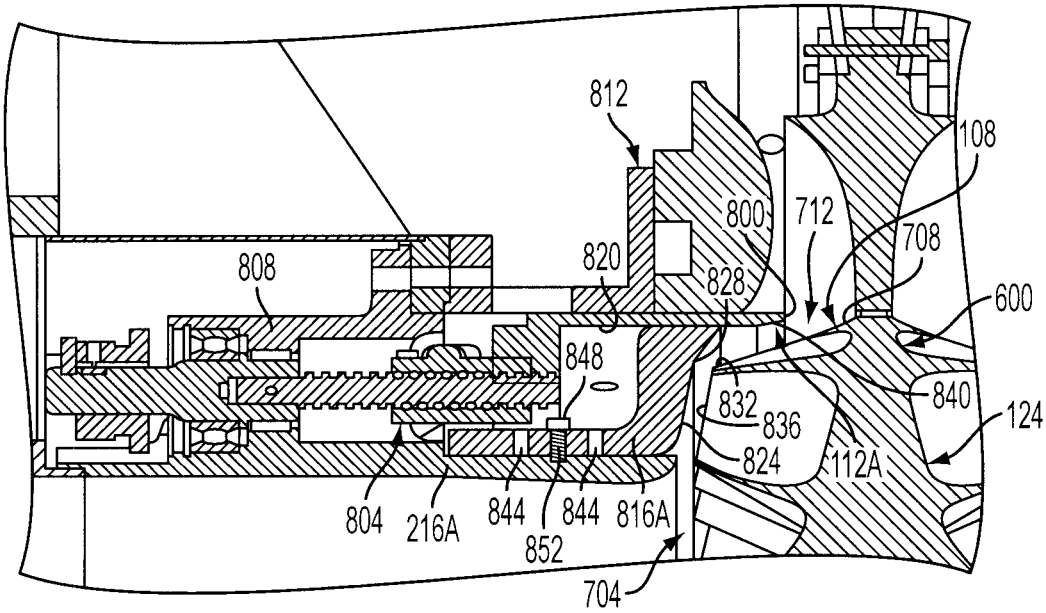
FIG. 8 is an enlarged cross-sectional partial view of the turbomachine of FIG. 1 showing the impeller shroud on one side of the impeller in a retracted position.
Figure 9:
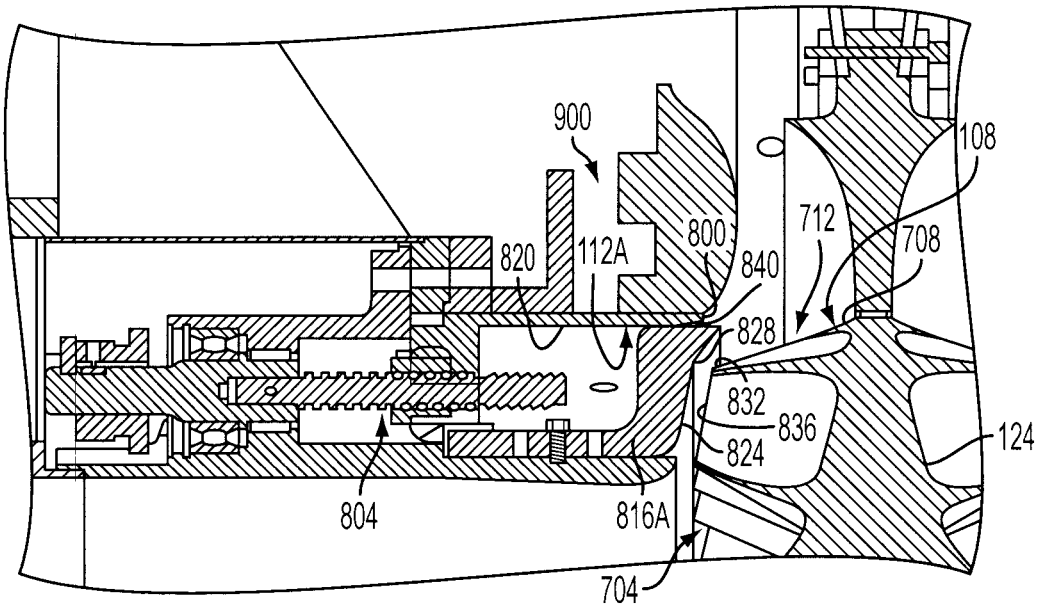
FIG. 9 is an enlarged cross-sectional partial view of the turbomachine of FIG. 1 showing the impeller shroud on one side of the impeller in an extended position.

Further ones of the unique features of turbomachine 100 particularly mentioned above are movable impeller shrouds 112A, 112B (FIG. 1), one of which (112A) is illustrated in more detail in FIGS. 8 and 9. As seen in each of FIGS. 8 and 9, impeller shroud 112A is cylindrical in shape and is located radially outward relative to impeller blades 108. Impeller shroud 112A defines a single edge 800 at its axial end most proximate to blade support 600 and is movable in an axial direction relative to rotational axis 132 (FIG. 1). In the embodiment shown, impeller shroud 112A is movable via an actuator (in this example screw-type actuator 804) that extends between the shroud and a fixed portion 808 of turbomachine 100. The actuator is effective to move impeller shroud 112A axially to differing positions that variably occlude fluid exhaust region 712 of impeller 124 to allow a user to control the operating characteristics of turbomachine 100.

In some positions, such as the position 812 shown in FIG. 8, impeller shroud 112A substantially overlaps blades 108 of impeller 124, thereby occluding fluid exhaust region 712. In other positions, such as the position 900 shown in FIG. 9, impeller shroud 112A is substantially or fully retracted from overlapping blades 108. In one example, in the most extreme extended position of impeller shroud 112A, edge 800 is spaced from the nearest surface(s) of blades 108 and/or blade support 600 by about 0.0762 centimeter (0.030 inch). In another example, as illustrated in FIG. 9, the most retracted position 900 of impeller shroud 112A places the edge 800 about 4.5 centimeters (1.78 inch) to the left (relative to FIG. 9) of its most extended position. By having a single edge 800 that is farther from rotational axis 132 (FIG. 1) than the most radially outward portions of trailing edges 708 of blades 108, shroud 112A has minimal fluid flow disruption on the leading-edge side of the blades at fluid intake region 704 of impeller 124. In other embodiments, impeller shroud 112A may be enhanced by fitting the shroud with a brush seal (not shown) that contacts impeller 124 in its most severely restricting position so as to provide additional control of the exhaust from fluid exhaust region 712 of the impeller. In yet other embodiments, solid-wall cylindrical shroud 212A shown may be replaced by a movable brush-type shroud (not shown).

As seen in each of FIGS. 8 and 9, turbomachine 100 may include a fixed shroud guide 816A that confronts the radially inner surface 820 of impeller shroud 112A. In the embodiment shown, shroud guide 816A provides a flow-defining surface 824 having a shape that substantially conforms to an envelope defined by the outline profile of blades 108 as impeller 124 is rotating. At a location 828 proximate the external corner 832 of each blade 108 formed by trailing edge 708 and the axially outer edge 836 of that blade, flow-defining surface 824 of shroud guide 816A angles generally toward impeller 124 to both prevent a sudden jump in the cross-sectional flow area at fluid exhaust region 712 and to assure a large obtuse angle between flow-defining surface 824 of the shroud guide and inner surface 820 of impeller shroud 112A. Edge 800 of impeller shroud 112A may include a bevel 840 on inner surface 820. It will be understood by those skilled in the art that these configurations of shroud 112A and shroud guide 816A assist in maintaining smoothly changing transitions between flow-defining surfaces in fluid exhaust region 712 of impeller 124 to assist in reducing flow separation and in maintaining high mass-flow. As mentioned above, in the context of a dynamometer, a high mass-flow through the dynamometer is found to permit power measurements with relatively high power rotating loads for a given size and other parameters of the dynamometer.

Figure 10:
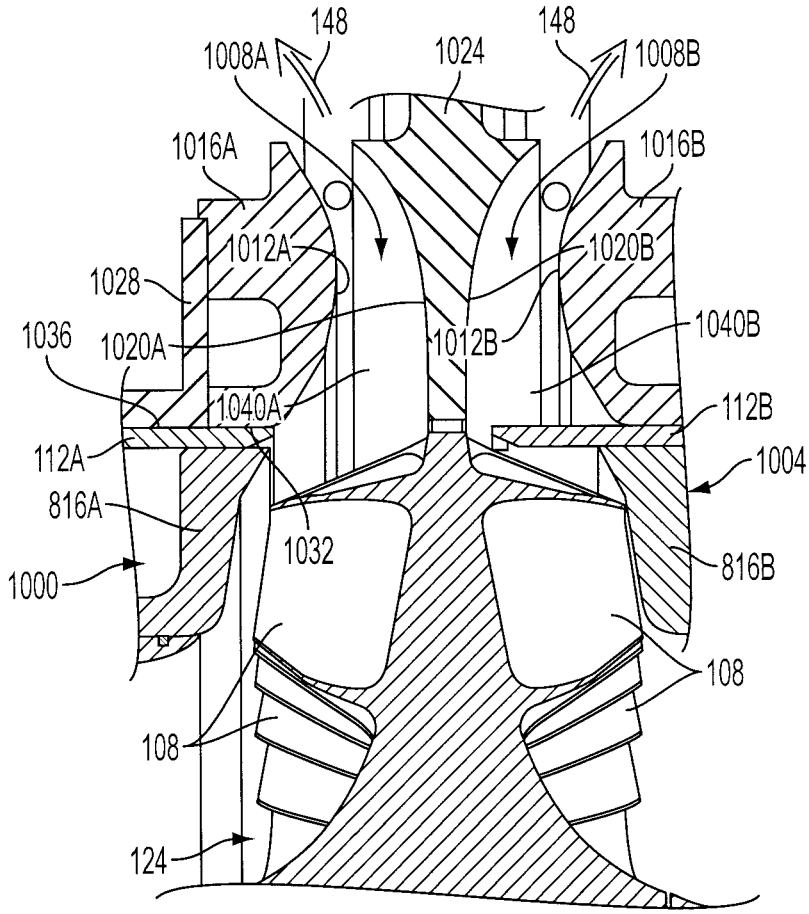
FIG. 10 is an enlarged cross-sectional partial view, with some structure deleted for clarity, of the outlet portion of the fluid flow diffuser illustrating the impeller shrouds on opposite sides of the impeller in different states of extension.

In the embodiment shown, shroud guide 816A is axially adjustable to multiple positions, thereby allowing a user to set the gap between the shroud guide and blades 108 to any one of a number of differing gaps to control performance characteristics of turbomachine 100. Two such positions are illustrated in FIG. 10 by the differing positions 1000, 1004 of shroud guides 816A, 816B, respectively, relative to blades 108 of impeller 124. The axial adjustability of each shroud guide 816A, 816B may be effected by providing several sets of a series of holes 844 provided in each shroud guide 816A, 816B and arranged along a line parallel to rotational axis 132 (FIG. 1) in which the sets are spaced from one another circumferentially relative to the rotational axis. In this example, a set of bolts 848 (one shown) is used to lock shroud guides in the desired location. Each bolt 848 extends through the selected one of holes 844 in each set of holes and threadedly engages a corresponding tapped receiving hole 852 in the respective one of outer portions 216A, 216B of rotor support 216 (see FIG. 2). Holes 844 in each set can be selectively engaged by a corresponding respective bolt 848 or other retaining device to maintain each shroud guide 816A, 816B in the selected axial position. In other embodiments, each shroud guide 816A, 816B can be mechanically driven independently relative to each other and/or independently relative to the corresponding impeller shroud 112A.

Yet a further one of the unique features of exemplary turbomachine 100 particularly mentioned above is a set 116 (FIG. 1) of exhaust diffusers. As shown in FIG. 10, after spending energy in driving rotor 120 (FIG. 1), the fluid (e.g., air) exits turbomachine 100 via a pair of exhaust diffusers 1008A, 1008B in a generally radial direction, as represented by arrows 148 (also appearing in FIG. 1). The portions of exhaust diffusers 1008A, 1008B just downstream from the corresponding respective blades 108 are each defined by a flow-defining surface 1012A, 1012B of a corresponding annular outer diffuser 1016A, 1016B and a flow-defining surface 1020A, 1020B of an annular center diffuser 1024. While these surfaces 1012A-B, 1020A-B are illustrated as generally convex and concave, respectively, it will be understood that other shapes that provide generally radial fluid flow are possible. Indeed, it may be desirable to provide a series of diffuser elements (not shown here, but see FIG. 11) along each exhaust diffuser 1008A, 1008B, each such diffuser element defining a particular form of flow segment. Such diffusers may perform various functions, including acoustical damping.

In FIG. 10, impeller shrouds 112A, 112B have differing axial positions relative to the impeller 124, as do shroud guides 816A, 816B. This is generally only for purposes of illustrating the movability or adjustability of these elements. In practice, it would be unlikely, though not impossible, that a situation would arise where such an asymmetrical load on the rotor was good practice. In most situations, impeller shrouds 112A, 112B would be equidistant from impeller 124, as would shroud guides 816A, 816B.

Each outer diffuser 1016A, 1016B may be supported by a corresponding flange 1028 (only the left flange is shown, the right one being outside the view of FIG. 10) fixed to a stationary portion of turbomachine 100 so that its radially innermost generally cylindrical surface 1032 is adjacent to the outer cylindrical surface 1036 of the corresponding impeller shroud, here, shroud 112. In this position, each outer diffuser 1016A, 1016B cooperates with the corresponding respective one of facing surfaces 1020A, 1020B of center diffuser 1024 to define portions 1040A, 1040B of exhaust diffusers 1008A, 1008B. Alternatively, outer diffusers 1016A, 1016B could be movably mounted to turbomachine 100 to permit different axial positions of surfaces 1012A, 1012B with respect to corresponding respective surface 1020A, 1020B of center diffuser 1024.

Each surface 1012A, 1012B includes a curved convex portion that defines, in conjunction with the facing smoothly curved concave portion of opposed surface 1020A, 1020B of center outlet baffle 1024, smoothly curving portion 1040A, 1040B that narrows smoothly in the axial dimension as it extends radially outward relative to rotational axis 132 (FIG. 1) of turbomachine 100. As mentioned above, other diffuser geometries, as well as multiple diffusers (not shown), may be desirable in particular situations. For example, successive diffusers might assist in controlling shock structures in the exiting fluid, might redirect the final outlet flow direction as the fluid exits the turbomachine, or might be employed for acoustical purposes.

Referring again to FIG. 1, in operation in a dynamometer exemplary turbomachine 100 would typically be factory-calibrated to determine settings values for each of variable-restriction intakes 104A, 104B, movable impeller shrouds 112A, 112B, and outlet diffusers 1016A, 1016B that a user can then use to adapt the dynamometer for use with a load of a particular shaft-horsepower. It has been found in one actual instantiation of a dynamometer that includes the features of turbomachine 100 that settings can be adjusted in this manner for use with loads of about 110 shaft-horsepower to about 9200 shaft-horsepower. Implementing one or more features of the present disclosure in other dynamometers having other mid-point shaft-horsepower operating points will also gain an increased range of shaft-horsepower over which it will function properly.

Figure 11:
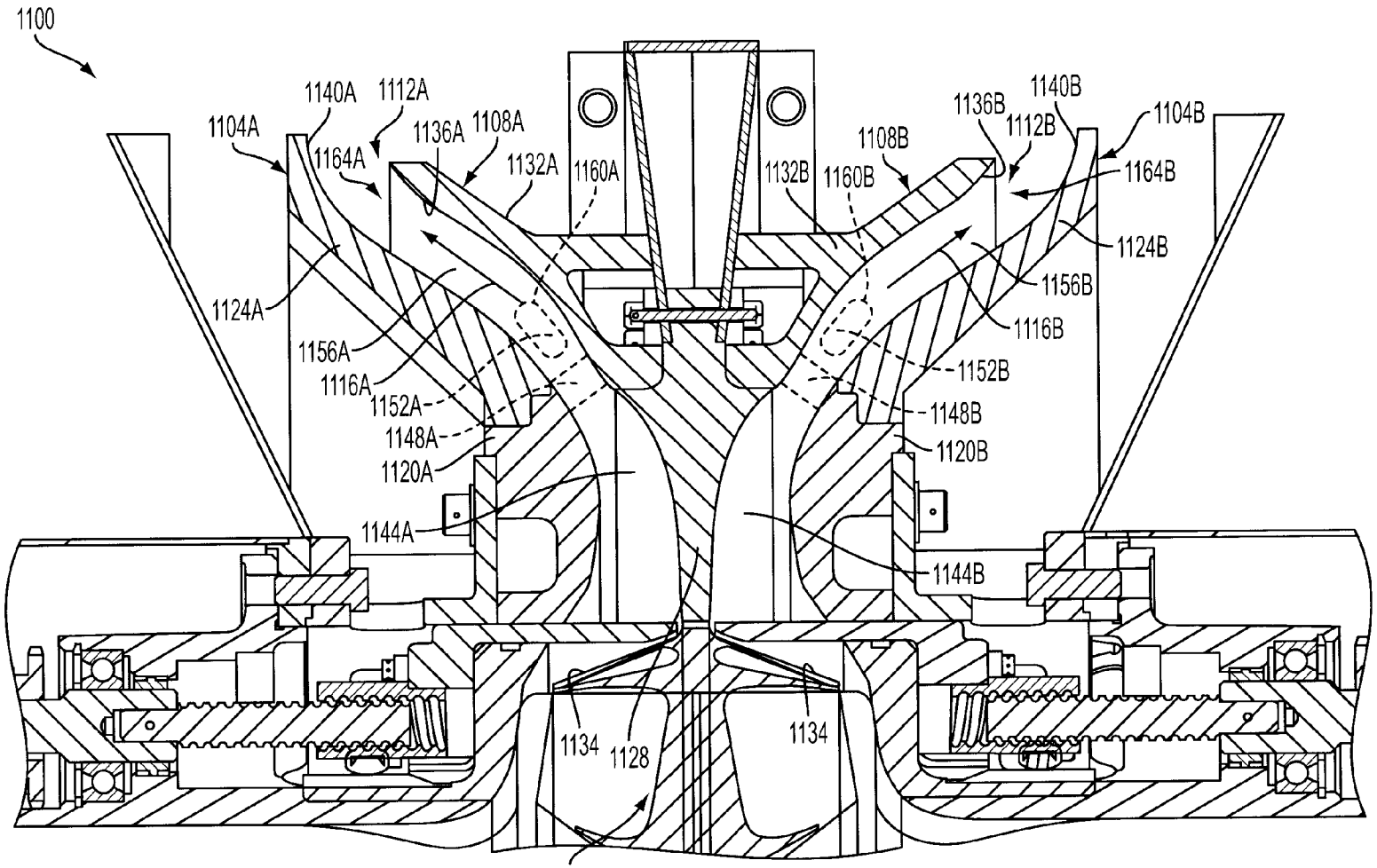
FIG. 11 is a cross-sectional partial view of outlet portions of an exemplary air-type dynamometer showing diffuser extensions for reducing the noise power level and Mach number of the outlet flow from the dynamometer.

FIG. 11 illustrates an air-type dynamometer 1100 made in accordance with concepts of the present invention. As alluded to above relative to turbomachine 100 of FIGS. 1-10, and in particular in describing outer and center diffusers 1016A, 1016B, 1024 in connection with FIG. 10, a turbomachine made in accordance with the present invention may have multiple diffuser elements in series with one another for each exhaust diffusers 1008A, 1008B. In other words, a turbomachine of the present invention may have one or more diffuser elements on each side of the turbomachine that would be in addition to diffuser elements represented by outer and center diffusers 1016A, 1016B, 1024 of FIG. 10. Outer and center diffusers 1016A, 1016B, 1024 of FIG. 10 are provided to turbomachine 100 to diffuse the outlet flow from corresponding respective outlet diffusers 1008A, 1008B. However, the configuration of diffusers 1016A, 1016B, 1024 that provides outlet diffusers 1008A, 1008B with a gradually decreasing flow area, while useful, can still produce supersonic flow at the outlets of the diffusers and corresponding relatively high-acoustic-power sound (jet noise) levels.

To reduce the levels of jet noise produced by the exhaust of a turbomachine having the general configuration of turbomachine 100 of FIGS. 1-10, the present inventors have devised outer and inner diffuser elements 1104A, 1108A, 1104B, 1108B that cooperate with one another to form specially shaped generally annular outlet diffusers 1112A, 1112B that cause the outlet flow 1116A, 1116B to experience a compressible flow shock, when air or any other gas is used as the dynamometer fluid, within the length of the outlet ducts so as to effect a change from supersonic flow to subsonic flow within the outlet ducts. At this point it is noted that in this example, outer diffuser elements 1104A, 1104B are made up of two parts 1120A, 1124A, 1120B, 1124B in which parts 1120A, 1120B are substantially the same as outer diffusers 1016A, 1016B of FIG. 10. Similarly, inner diffuser elements 1108A, 1108B are made of two parts, i.e., a portion of a center diffuser 1128 and a corresponding respective one of parts 1132A, 1132B. Center diffuser 1128 in this example is substantially identical to center diffuser 1024 of FIG. 10. Although outer and inner diffuser elements 1104A, 1104B, 1108A, 1108B are shown here as being made of separate parts 1120A, 1120B, 1124A, 1124B, 1128, 1132A, 1132B connected together, those skilled in the art will readily appreciate that the outer and inner diffuser elements may each be monolithic or, alternatively, may each be made of more than two parts.

Indeed, in this example the entirety of dynamometer 1100 of FIG. 11, except for diffuser elements 1108A, 1108B and diffuser element parts 1124A, 1124B, is substantially the same as the corresponding parts on turbomachine 100 of FIGS. 1-10. That said, those skilled in the art will understand that while most of dynamometer 1100 of FIG. 11 is substantially the same as turbomachine 100 of FIGS. 1-10, this is done for convenience of comparing with one another the conditions of the outlet flows of the two machines. Consequently, those skilled in the art will appreciate that while both turbomachine 100 and dynamometer 1100 include all of the other unique features described above, such as variable-restriction intakes, uniquely shaped impeller blades and a pair of movable impeller shrouds, neither machine need necessarily include all of these features. Rather, other embodiments of turbomachines made in accordance with concepts of the present invention may have fewer than all of these features in various combinations with one another.

As can be seen in FIG. 11, each outlet diffuser 1112A, 1112B extends from the radially outer (relative to the rotational axis (not shown) of rotor 1130) extents of impeller blades 1134 to the respective radially outermost edges of the inner and outer outlet-duct-defining surfaces 1136A, 1140A, 1136B, 1140B of the inner and outer diffuser elements 1108A, 1104A, 1108B, 1104B. Each outlet diffuser 1112A, 1112B may be considered to be parsable into four distinct regions along its length based on the area of flow in those regions (correspondingly the distance between inner and outer surfaces 1136A, 1140A perpendicular to the axis of flow in outlet diffuser 1112A on the one side and the distance between inner and outer surfaces 1136B, 1140B perpendicular to the axis of flow in outlet diffuser 1112B on the other). These regions are: 1) a strictly decreasing region 1144A, 1144B; 2) a maximum-constriction region 1148A, 1148B; 3) an abruptly increasing region 1152A, 1152B and a gradually increasing region 1156A, 1156B. In the example of FIG. 11, it is noted how in each of outlet diffuser 1112A, 1112B that inner surface 1136A, 1136B has two reversals of curvature in defining maximum-constriction region 1148A, 1148B, whereas outer surface 1140A, 1140B maintains a single-direction curvature throughout the maximum-construction region and abruptly increasing region 1152A, 1152B. These profiles of inner and outer surfaces 1136A, 1136B, 1140A, 1140B in this example act to inhibit separation/recirculation along the inner surfaces.

For convenience, the curvature of portions of inner and outer surfaces 1136A, 1136B, 1140A, 1140B are defined herein and in the appended claims in terms of the direction of curvature relative to the flow axis within each outlet diffuser 1112A, 1112B. Consequently, it can be readily seen from FIG. 11 that each outer surface 1140A, 1140B has a convex curvature, except proximate the outlet end of gradually increasing region 1156A, 1156B where it changes to concave. Similarly, with this convention it can be readily seen that each inner surface 1136A, 1136B, starting at strictly decreasing region 1144A, 1144B and ending at the outlet end of gradually increasing region 1156A, 1156B, starts out concave, transitions to convex (in the region of maximum-constriction region 1148A, 1148B), transitions back to concave and then ends after a transition back to convex.

Generally, ones of the various regions 1144A, 1144B, 1148A, 1148B, 1152A, 1152B, 1156A, 1156B work together as follows to convert the supersonic airflow in strictly decreasing regions 1144A, 1144B to subsonic flow at the outlet end of gradually increasing regions 1156A, 1156B. The location of abruptly increasing regions 1152A, 1152B immediately downstream of corresponding respective maximum-constriction regions 1148A, 1148B causes a compressible flow shock zone 1160A, 1160B to form in this region. In the present context, the term "abruptly increasing" represents an expansion of airflow area/passage within a short distance, such as 1 inch (2.54 cm). These shock zones 1160A, 1160B define the transition locations between the supersonic airflows exiting maximum-constriction regions 1148A, 1148B and the regions 1164A, 1164B of subsonic airflow. The location of shock zones 1160A, 1160B along the lengths of outlet diffusers 1112A, 1112B are also controlled by the respective lengths of gradually increasing regions 1156A, 1156B, as well as the rate of gradual flow area increase within these regions.

Example

This example is based on an air dynamometer having a turbomachine configuration substantially identical to turbomachine 100 of FIGS. 1-10 having a design power of 3,400 HP (two sides) at 17,000 rpm with a wide-open setting of impeller shrouds 112A, 112B (as shown on the left side of FIG. 10) and a clearance of 0.391 in. (9.93 mm) between each of shroud guides 816A, 816B and corresponding respective blade 108 (FIG. 10). At these settings and under full power, the average absolute Mach number of the airflow at the exit of each outlet diffuser 1008A, 1008B (FIG. 10) is about 1.22, i.e., supersonic. However, with the addition of extensions to outer and center diffusers 1016A, 1016B, 1024 (FIG. 10) (as is essentially shown in FIG. 11 by the addition of diffuser part 1124A, 1124B, 1132A, 1132B to, respectively, diffuser parts 1120A, 1120B, 1128), the average absolute Mach number of the flow exiting extended outlet diffusers 1112A, 1112B is about 0.79, i.e., subsonic. Referring to FIG. 11, the absolute Mach number at the interfaces between corresponding respective pairs of diffuser parts 1120A, 1124A, 1120B, 1124B, which corresponds to the exits of outlet diffusers 1008A, 1008B of FIG. 10, is about 1.22, i.e., about the same as without the extensions embodied by diffuser part 1124A, 1124B, 1132A, 1132B.

As mentioned above, this supersonic-to-subsonic flow transition is brought about by the configuration of outlet diffusers 1112A, 1112B of FIG. 11, especially due to corresponding respective maximum-constriction regions 1148A, 1148B, abruptly increasing regions 1152A, 1152B and gradually increasing regions 1156A, 1156B, which cause a shock to occur, here in the abruptly increasing regions. In this example, the maximum absolute Mach number in the shock zones is on the order of 1.8. In the relatively long gradually increasing regions 1156A, 1156B downstream of the shock zone, the absolute Mach number substantially decreases from a maximum of 1.8 to 0.79 at the outlet with substantial mixing occurring in this region. In conjunction with this decrease in exit velocity to subsonic levels as between the embodiments of FIG. 10 and FIG. 11 comes a decrease in average acoustic power level at the exits of outlet diffusers 1008A, 1008B on the one hand and outlet diffusers 1112A, 1112B on the other. In this example, the average exit acoustic power level decreases from 155.1 dB (FIG. 10) to 147 dB (FIG. 11). In addition to the decreases in average exit Mach number and average exit acoustic power level, the addition of the extensions shown in FIG. 11 causes increases in mass flow and power absorbed by the two sides of dynamometer 1100. At 17,000 rpm, adding the extensions, i.e., diffuser part 1124A, 1124B, 1132A, 1132B of FIG. 11, increases the mass flow of the exemplary dynamometer from 16.56 lbm/s to 16.953 lbm/s and increases the power absorbed from 3,562.7 hp to 3,949.9 hp, increases of 2.54% and 11.39%, respectively.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A machine, comprising:

a radial-flow turbomachine that includes:

a housing;

an impeller rotatably mounted in said housing for receiving rotational energy from an external rotating driver when said radial-flow turbo machine is operating, said impeller having a fluid intake region and an annular fluid exhaust region located radially outward from said fluid intake region; and a fluid intake for communicating a fluid to said fluid intake region of said impeller as an intake fluid flow when said radial-flow turbomachine is operating, said fluid intake including an adjustable throttling device that allows the intake fluid flow to be selectably restricted.

2. A machine according to claim 1, wherein said fluid intake includes an intake duct, said throttling device comprises an adjustable flow restrictor that includes a movable structure movable into a plurality of positions so as to provide said intake duct with differing cross-sectional flow areas.

3. A machine according to claim 2, wherein said impeller has a rotational axis and said intake duct is annular around said rotational axis, said intake duct being partially defined by a stationary wall, and said adjustable flow restrictor including a movable wall spaced from said stationary wall so as to define a variably restricted portion of said intake duct.

4. A machine according to claim 3, wherein said stationary wall has a circular shape in a plane perpendicular to said rotational axis of said impeller, said circular shape continuously diminishing in diameter from a first location distal from said impeller to a second location proximal to said impeller.

5. A machine according to claim 1, wherein said impeller has a rotational axis and includes:

a blade support extending radially from said rotational axis; and a plurality of blades distal from said rotational axis;

said turbomachine further including:

an annular exhaust diffuser in fluid communication with said fluid exhaust region of said impeller; and a movable impeller-blade shroud concentric with said rotational axis, said movable impeller-blade shroud being movable so as to variably occlude said exhaust diffuser.

6. A machine according to claim 5, wherein said movable impeller-blade shroud is substantially cylindrical and locatable only radially outward of said plurality of blades relative to said rotational axis of said impeller.

7. A machine according to claim 5, wherein each of said plurality of blades has a leading edge, a trailing edge and a free end extending between said leading and trailing edges, said trailing edge being disposed radially farther from said rotational axis of said impeller than said leading edge, said leading and trailing edges being angled to converge toward one another to a point beyond said free end.

8. A machine according to claim 7, wherein portions of said leading and trailing edges closest to said blade support lie on differing reference radii extending from said rotational axis of said impeller.

9. A machine according to claim 5, wherein said blade support has two sides in a direction parallel to said rotational axis of said impeller, said plurality of blades distributed on both said two sides, said turbomachine further comprising:

a center diffuser located immediately circumferentially around said impeller; and first and second annular outer diffusers located on opposite sides of said center diffuser such that said first annular outer diffuser and said center diffuser define a first annular exhaust diffuser and said second annular outer diffuser and said center diffuser define a second annular exhaust diffuser.

10. A machine according to claim 1, wherein the machine is a dynamometer and said radial-flow turbomachine includes a load interface designed and configured to removably couple a rotating load to said impeller.

11. A machine according to claim 10, wherein the fluid is air.

12. A machine according to claim 1, wherein said radial-flow turbomachine has an exhaust diffuser designed and configured to reduce supersonic flow to subsonic flow.

13. A machine, comprising:

a radial-flow turbomachine that includes:

a housing;

an impeller rotatably mounted in said housing for receiving rotational energy from an external rotating driver when said radial-flow turbo-machine is operating, said impeller having a rotational axis, a fluid intake region, and a fluid exhaust region located radially outward from said fluid intake region, said impeller including:

a blade support extending radially from said rotational axis; and a plurality of blades distal from said rotational axis;

an exhaust diffuser in fluid communication with said fluid exhaust region of said impeller; and a movable cylindrical impeller-blade shroud concentric with said rotational axis, said movable cylindrical impeller-blade shroud being locatable only radially outward of said plurality of blades relative to said rotational axis of said impeller and movable so as to variably occlude said exhaust diffuser.

14. A machine according to claim 13, wherein said movable impeller shroud moves in a direction parallel to said rotational axis of said impeller.

15. A machine according to claim 13, further including a shroud guide confronting, but spaced from, said plurality of blades in a direction parallel to said rotational axis of said impeller, said shroud guide having a surface that faces said impeller and that defines a portion of said exhaust diffuser.

16. A machine according to claim 13, wherein said portion of said exhaust flow duct has a cross-sectional area and said shroud guide is movable in a direction parallel to said rotational axis of said impeller so as to change said cross-sectional area of said portion of said exhaust diffuser.

17. A machine, comprising:

a radial-flow turbomachine that includes:

a housing;

an impeller rotatably mounted in said housing for receiving rotational energy from an external rotating driver when said radial-flow turbomachine is operating, said impeller having a rotational axis, a fluid intake region, and a fluid exhaust region located radially outward from said fluid intake region, said impeller including:

a blade support extending radially from said rotational axis; and a plurality of blades distal from said rotational axis, wherein each of said plurality of blades has a leading edge, a trailing edge and a free end extending between said leading and trailing edges, said trailing edge being disposed radially farther from said rotational axis of said impeller than said leading edge, said leading and trailing edges being angled to converge toward one another to a point beyond said free end; and an impeller shroud.

18. A machine according to claim 17, wherein said impeller shroud is generally cylindrical and is movable in a direction parallel to said rotational axis between first and second positions that have differing spacings from a nearest surface of said impeller.

19. A machine according to claim 17, wherein each of said plurality of blades has a concave primary fluid-engaging surface.

20. A machine according to claim 17, wherein portions of said leading and trailing edges closest to said blade support lie on differing reference radii extending from said rotational axis of said impeller.

21. A machine, comprising:

a radial-flow turbomachine that includes:

a housing;

an impeller rotatably mounted in said housing for receiving rotational energy from an external rotating load when said radial-flow turbomachine is operating, said impeller having a rotational axis, an outer circumferential periphery, a fluid intake region, and an annular fluid exhaust region located radially outward from said fluid intake region;

a first exhaust diffuser in fluid communication with said fluid exhaust region;

a center diffuser substantially aligned with said circumferential periphery of said impeller in a direction parallel to said rotational axis of said impeller, said center diffuser located radially outward relative to said impeller; and a first outer diffuser offset from said center outlet baffle in a direction parallel to said rotational axis of said impeller so as to define a first portion of said first exhaust diffuser between said first outer diffuser and said center diffuser.

22. A machine according to claim 21, wherein said impeller includes:

a blade support extending radially from said rotational axis and having two sides located on opposite sides of a plane extending through said blade support perpendicular to said rotational axis; and a plurality of blades distal from said rotational axis and distributed on said two sides of said blade support;

said first exhaust diffuser in fluid communication with a first of said two sides and said radial-flow turbomachine further including a second exhaust diffuser in fluid communication with a second of said two sides;

wherein said center diffuser has two diffuser-defining surfaces that are oppositely directed from one another and define portions of corresponding respective ones of said first and second exhaust diffusers.

23. A machine according to claim 21, further comprising a fluid intake for communicating a fluid to said fluid intake region of said impeller as an intake fluid flow when said radial-flow turbomachine is operating, said fluid intake including an adjustable throttling device that allows the intake fluid flow to be selectably restricted.

24. A machine according to claim 21, further comprising a movable cylindrical impeller-blade shroud concentric with said rotational axis, said movable cylindrical impeller-blade shroud being locatable only radially outward of said plurality of blades relative to said rotational axis of said impeller and movable so as to variably occlude said first exhaust diffuser.

25. A machine according to claim 24, further comprising a fluid intake for communicating a fluid to said fluid intake region of said impeller as an intake fluid flow when said radial-flow turbomachine is operating, said fluid intake including a throttling device that allows the intake fluid flow to be selectably restricted.

26. A machine according to claim 25, wherein each of said plurality of blades has a leading edge, a trailing edge and a free end extending between said leading and trailing edges, said trailing edge being disposed radially farther from said rotational axis of said impeller than said leading edge, said leading and trailing edges being angled to converge toward one another to a point beyond said free end.

27. A machine according to claim 24, wherein each of said plurality of blades has a leading edge, a trailing edge and a free end extending between said leading and trailing edges, said trailing edge being disposed radially farther from said rotational axis of said impeller than said leading edge, said leading and trailing edges being angled to converge toward one another to a point beyond said free end.

28. A machine according to claim 21, wherein each of said plurality of blades has a leading edge, a trailing edge and a free end extending between said leading and trailing edges, said trailing edge being disposed radially farther from said rotational axis of said impeller than said leading edge, said leading and trailing edges being angled to converge toward one another to a point beyond said free end.

29. A machine, comprising:

a radial-flow turbomachine that includes:

a housing;

an impeller rotatably mounted in said housing for receiving rotational energy from an external rotating load when said radial-flow turbomachine is operating, said impeller having a rotational axis, a fluid intake region, and a fluid exhaust region located radially outward from said fluid intake region, said impeller including:

a blade support extending radially from said rotational axis; and a plurality of blades distal from said rotational axis; and an exhaust diffuser in fluid communication with said fluid exhaust region of said impeller and having an inlet proximate to said fluid exhaust region and an outlet distal from said inlet, said exhaust diffuser having a shape selected so that, when said inlet is receiving supersonic airflow, said shape causes the supersonic flow to experience a shock within said exhaust diffuser and causes flow at said exit to be subsonic.

30. A machine according to claim 29, wherein said exhaust diffuser includes, in order from said inlet to said outlet, a strictly decreasing-area region, a maximum-constriction region, an abruptly increasing-area region, and a gradually increasing-area region.

31. A machine according to claim 30, wherein said maximum constriction region, said abruptly increasing-area region, and said gradually increasing-area region are configured to cause the shock to occur substantially within said abruptly increasing-area region.

32. A machine according to claim 29, wherein said exhaust diffuser is annular in shape, is defined from an inner surface and an outer surface spaced from said inner surface, and has a central flow axis, said outer surface having substantially only a convex shape between said inlet and said outlet, and said inner surface transitioning from a concave shape proximate said inlet to a convex shape and from said convex shape to a concave shape proximate said outlet.

33. A machine according to claim 32, wherein said exhaust diffuser includes, in order from said inlet to said outlet, a strictly decreasing-area region, a maximum-constriction region, an abruptly increasing-area region, and a gradually increasing-area region, said maximum-construction region being defined by said outer surface and said convex shape of said inner surface.

* * * * *